US006750600B2

(12) United States Patent
Kaufman et al.

(10) Patent No.: US 6,750,600 B2
(45) Date of Patent: Jun. 15, 2004

(54) HALL-CURRENT ION SOURCE

(75) Inventors: Harold R. Kaufman, LaPorte, CO (US); James R. Kahn, Ft. Collins, CO (US); Raymond S. Robinson, Ft. Collins, CO (US); Viacheslav V. Zhurin, Ft. Collins, CO (US)

(73) Assignee: Kaufman & Robinson, Inc., Ft. Collins, CO (US)

( * ) Notice: Subject to any disclaimer, the term of this patent is extended or adjusted under 35 U.S.C. 154(b) by 154 days.

(21) Appl. No.: 09/848,644

(22) Filed: May 3, 2001

(65) Prior Publication Data

US 2002/0163289 A1 Nov. 7, 2002

(51) Int. Cl.[7] ..... H01J 27/02

(52) U.S. Cl. ..... 313/361.1; 313/231.01; 313/231.11; 313/231.71; 313/362.1; 313/259.1; 118/723; 315/111.81

(58) Field of Search ..... 313/213.11, 213.21, 313/361.1, 362.1, 359.1, 231.01, 231.71, 231; 118/723; 315/111.81

(56) References Cited

U.S. PATENT DOCUMENTS 4,481,062 A * 11/1984 Kaufman et al. ..... 156/345.39
4,782,235 A * 11/1988 Lejeune et al. ..... 250/423 R
4,846,953 A * 7/1989 Yoshida ..... 204/298.01
4,862,032 A * 8/1989 Kaufman et al. ..... 313/359.1
5,315,121 A * 5/1994 Kluge et al. ..... 250/423 R
5,763,989 A * 6/1998 Kaufman ..... 313/361.1
6,238,537 B1 * 5/2001 Kahn et al. ..... 204/298.04
6,454,910 B1 * 9/2002 Zhurin et al. ..... 204/192.12
6,456,011 B1 * 9/2002 Bugrova et al. ..... 315/111.91
6,504,294 B1 * 1/2003 Mahoney et al. ..... 313/359.1

* cited by examiner

*Primary Examiner*—Nimeshkumar D. Patel
*Assistant Examiner*—Holly Harper
(74) *Attorney, Agent, or Firm*—Dean P. Edmundson

(57) ABSTRACT

In accordance with one specific embodiment of the present invention, a Hall-current ion source of the end-Hall type has an anode that is contoured with one or more recesses in the electron-collecting surface which have areas that are protected from the deposition of externally generated contamination thereon, as well as one or more protrusions that have higher temperatures than the bulk of the anode, thereby increasing the removal or passivation of coatings during operation by the thermal degradation of the coating and the effects of thermomechanical stresses. In another specific embodiment, which can be combined with the above embodiment, electrically isolated baffle or baffles are located to protect a substantial fraction of the electron-collecting surface of the anode from the deposition of externally generated contamination thereon.

14 Claims, 5 Drawing Sheets

HALL-CURRENT ION SOURCE

FIELD OF INVENTION

This invention relates generally to ion and plasma sources. More particularly it pertains to plasma and ion sources that utilize a Hall current in the generation of the electric field that accelerates ions in a neutral plasma, and it further pertains to the performance of such sources and their being able to operate in adverse environments in which poorly conducting or nonconducting coatings are formed or deposited upon the ion sources or particular components thereof.

This invention can find application in industrial processes such as sputter etching, sputter deposition, coating and property enhancement. It can also find application in electric space propulsion.

BACKGROUND

The acceleration of ions to form energetic beams of ions has been accomplished both electrostatically and electromagnetically. The present invention pertains to sources that utilize electromagnetic acceleration. Such sources have variously been called plasma, electromagnetic, and gridless ion sources. Because the ion beams are dense enough to require the presence of electrons to avoid the disruptive mutual repulsion of the positively charged ions, the ion beams are neutralized plasmas and the ion sources are also called plasma sources.

In ion sources (or thrusters) with electromagnetic acceleration, there is a discharge between an electron-emitting cathode and an anode located either within the discharge region or at a boundary thereof. The accelerating electric field is established by the interaction of the electron current in this discharge with a magnetic field located between the anode and cathode. This interaction generally includes the generation of a Hall current normal to both the magnetic field direction and the applied electric field. For efficient operation of a Hall-current ion source, the Hall current must follow a closed path—i.e., with no interruptions to this path.

A Hall-current ion source can have a circular discharge region with only an outside boundary, where the ions are generated and accelerated continuously over the circular cross section of this channel. The closed path for the Hall current follows a circular path within this circular cross section. This type of Hall-current ion source, called the end-Hall type, has a generally axial magnetic field shape as shown in U.S. Pat. No. 4,862,032—Kaufman et al., and as described by Kaufman, et al., in *Journal of Vacuum Science and Technology* A, Vol. 5, No. 4, beginning on page 2081. These publications are incorporated herein by reference.

A Hall-current ion source can also have an annular discharge region with both inner and outer boundaries, where the ions are generated and accelerated only over an annular cross section. The closed path for the Hall current follows a circular path within this annular cross section. This type of Hall-current ion source, called the closed-drift type, usually has a generally radial magnetic field shape as shown in U.S. Pat. No. 5,359,258—Arkhipov, et al., and U.S. Pat. No. 5,763,989—Kaufman, and as described by Zhurin, et al., in *Plasma Sources Science & Technology*, Vol. 8, beginning on page R1. These publications are also incorporated herein by reference.

The cross sections of the discharge regions are described above as being circular or annular, but it should be noted the cross-sections, and hence the Hall-current paths, may have elongated or "race-track" shapes. Such alternative shapes are described in the references cited. It should also be noted that the magnetic field shape can depend on the desired beam shape. For example, a radially directed ion beam would have a magnetic field generally at right angles to the magnetic field that would be used to generate an axially directed ion beam.

Those skilled in the operation of the end-Hall type of Hall-current ion source, described the aforementioned U.S. Pat. No. 4,862,032—Kaufman et al., are aware that a poorly conducting or nonconducting coating can accumulate on the exposed anode surface of this ion source. The coating can result from the direct deposition of material on the anode during a dielectric deposition application. The coating can also result from the operation of the ion source in the presence of gases such as oxygen or nitrogen, which can form a dielectric coating from conducting materials deposited on the anode, or even from the anode material itself. This coating gradually increases the discharge voltage and often prevents restarting the discharge after a prolonged period of operation in an adverse environment. (If the operation is voltage limited, the current will gradually decrease.) In an extreme case, it can result in a premature termination of operation.

The adverse effects of poorly conducting or nonconducting coatings on the anode have also been observed in a closed-drift type of Hall-current ion source, and are described in U.S. Pat. No. 5,973,447—Mahoney, et al., also incorporated herein by reference. The solution proposed therein is to introduce the working gas through a gap in a cooled anode, so that the electrical contact of the discharge to the anode can be sustained through the gap after exposed surfaces of the anode become coated with dielectric coatings.

The preceding examples illustrate the problems caused by poorly conducting or nonconducting coatings on the anodes of Hall-current ion sources. These problems are most frequently observed in applications in which dielectrics are deposited on substrates, with some of the dielectric material also being deposited on any nearby Hall-current ion sources, particularly on the anodes of such sources. Dielectric anode depositions are also observed in applications where reactive gases are present and such coatings can be formed at the anode surface, in some cases incorporating the anode material into the coating. Dielectric anode coatings can even be observed in space electric propulsion applications where the dielectric is deposited on the anode due to the sputtering of some other component of the ion source, which is called a thruster when it is used for propulsion. The nature of the problems encountered due to these coatings range from changing the operating characteristics to preventing operation.

The accumulation of poorly conducting or nonconducting coatings on the anode during operation in an adverse environment constitutes an inherent limitation of the Hall-current ion sources described above. The most common industrial solution for such coatings is maintenance, i.e., disassembly, cleaning and/or replacement of components. Such maintenance, however, interrupts production and increases costs. In space applications, maintenance is generally not practical. Longer operating times in adverse environments would be desirable, preferably with little or no change in operating characteristics.

SUMMARY OF INVENTION

In light of the foregoing, it is an overall general object of the invention to provide a Hall-current ion source with improved tolerance to the deposition of a poorly conducting or nonconducting coating on the ion source.

A more specific object of the present invention is to provide a Hall-current ion source in which the deposition of a poorly conducting or nonconducting coating thereon has a reduced effect on operating characteristics.

A further object of the present invention is to provide a Hall-current ion source which has an increased operating time without maintenance when subjected to the deposition of a poorly conducting or nonconducting coating thereon.

Yet another object of the present invention is to provide a Hall-current ion source in which the anode surface is protected against deposition by the geometry of the ion source.

Still another object of the present invention is to provide a Hall-current ion source in which an anode coating is minimized though thermal and/or mechanical effects.

In accordance with one specific embodiment of the present invention, a Hall-current ion source of the end-Hall type has an anode that is contoured with one or more recesses in the electron-collecting surface which have areas that are protected from the deposition of externally generated contamination thereon, as well as one or more protrusions that have higher temperatures than the bulk of the anode, thereby increasing the removal or passivation of coatings during operation by the thermal degradation of the coating and the effects of thermomechanical stresses.

In another specific embodiment, which can be combined with the above embodiment, electrically isolated baffle or baffles are located to protect a substantial fraction of the electron-collecting surface of the anode from the deposition of externally generated contamination thereon.

DESCRIPTION OF FIGURES

Features of the present invention which are believed to be patentable are set forth with particularity in the appended claims. The organization and manner of operation of the invention, together with further objectives and advantages thereof, may be understood by reference to the following descriptions of specific embodiments thereof taken in connection with the accompanying drawings, in the several figures of which like reference numerals identify like elements and in which:

It may be noted that the aforesaid schematic views represent the surfaces in the plane of a cross-section while avoiding the clutter which would result were there also a showing of the background edges and surfaces of the overall generally-cylindrical-assemblies.

DESCRIPTION OF PRIOR ART

Figure 1:
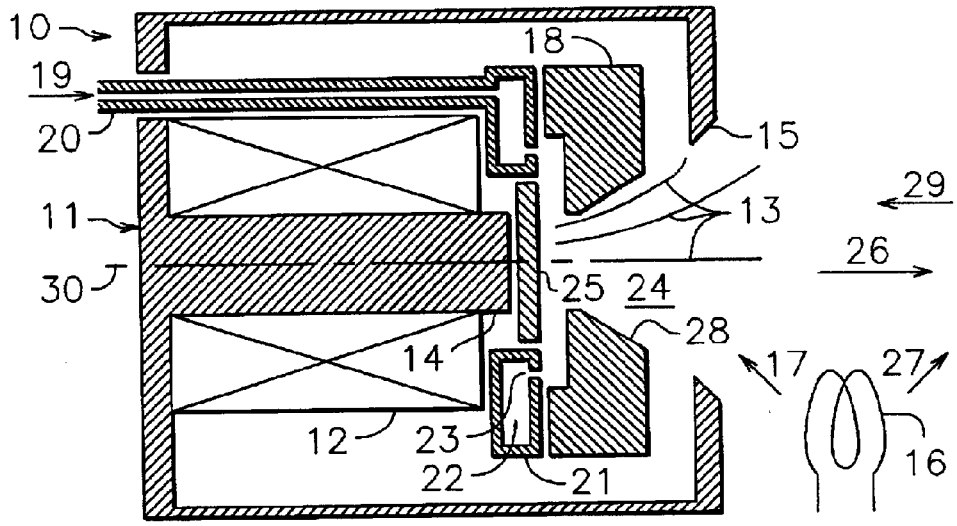
Fig. 1 (PRIOR ART)
FIG. 1 is a schematic cross-sectional view of a prior-art Hall-current ion source of the end-Hall type.

Referring to FIG. 1, there is shown an approximately axisymmetric Hall-current ion source of the prior art, more particularly one of the end-Hall type. Ion source 10 includes magnetically permeable path 11, which is magnetically energized by magnet coil 12. (An electromagnet, magnet coil 12 is the magnetizing means in ion source 10, but a permanent magnet could have been used instead.) Magnetic field 13 (shown only on one side of the axis of symmetry to reduce the clutter) is thereby generated between magnetically permeable inner pole piece 14 and magnetically permeable outer pole piece 15. A discharge means is provided by electron-emitting cathode 16, which emits electrons 17 that flow toward anode 18. Ionizable gas 19 is introduced into ion source 10 through tube 20 which connects to manifold 21. This manifold has interior volume 22 to circumferentially distribute the gas to apertures 23, which in turn permit a flow of gas to discharge region 24 enclosed laterally by anode 18 and at one end by reflector 25. Electrons 17 are constrained by magnetic field 13 located in discharge region 24 between cathode 16 and anode 18 and so oriented that the electrons cannot flow directly to anode 18, but remain in discharge region 24 until, through collision processes, they can diffuse across the magnetic field to reach the anode. Some of the collisions are with neutral atoms or molecules of the ionizable gas and generate ions, which are accelerated in the axial direction to become ion beam 26. Additional electrons 27 from cathode 16 charge and current neutralize the ion beam. With the exception of cathode 16 and tube 20, the configuration shown is essentially axially symmetric about axis 30. With both ion source 10 and ion beam 26 axially symmetric, axis 30 is the axis of symmetry of both ion source 10 and ion beam 26.

Anode 18 is connected to the positive terminal of a discharge power supply (not shown), while electron-emitting cathode 16 is connected to the negative terminal. The cathode is typically operated at or near ground potential, which is normally defined as the potential of the surrounding vacuum chamber. A hot filament cathode is indicated schematically in FIG. 1. Such a cathode requires an addition heating supply. A hollow cathode could also be used for the electron-emitting cathode, in which case additional starting and keeper supplies could be required.

The electrons that reach anode 18 are collected by conical surface 28 of anode 18. Surface 28 is also the "electron-collecting surface," which is defined as the anode surface readily available and utilized for electron collection. In contrast, to reach surfaces of anode 18 other than surface 28, electrons must cross additional magnetic field lines, diffuse farther from the discharge region, or both. Conical surface 28 is also exposed to externally generated contamination 29. Most externally generated contamination 29 follows straight-line trajectories from the points of origin. If a point on anode surface 28 can be reached directly by a straight line originating at another point external to ion source 10 (i.e., without being intercepted by another part of the ion source), that point on anode surface 28 can become coated with externally generated contamination.

This contamination can be sputtered material from a target that is being etched by the ion beam, or it may be material from a nearby device such as an electron-beam evaporator. The contaminant may be a dielectric, or it may be a material that reacts with a background gas to form a dielectric. Examples of the latter would be aluminum or silicon, which can be oxidized with background oxygen into $Al_2O_3$ or $SiO_2$ after being deposited on the anode. The anode coating may also be a poor conductor rather than a nonconductor, such as would result from a dielectric with poor stoichiometry or the inclusion of impurities.

The formation of a poorly conducting or nonconducting coating on conical surface 28 can impede the flow of electrons to anode 18 and adversely affect the operation of ion source 10. The efficiency of operation can be reduced, the shape of the ion beam can be altered, and the minimum operating voltage can be increased. In an extreme case, operation of the ion source can be prevented by such a film.

The preceding description is directed at contamination generated external to the ion source. It is also possible to have internally generated contamination. If the working gas for the ion source is oxygen or nitrogen, a dielectric coating of oxide or nitride can form on the anode. In some cases, a nonconducting oxide layer has been formed on the anode, even though the anode was fabricated of nonmagnetic stainless steel (type 304). Operation on hydrocarbon working gases can also result in a diamondlike dielectric coating on the anode.

Figure 2:
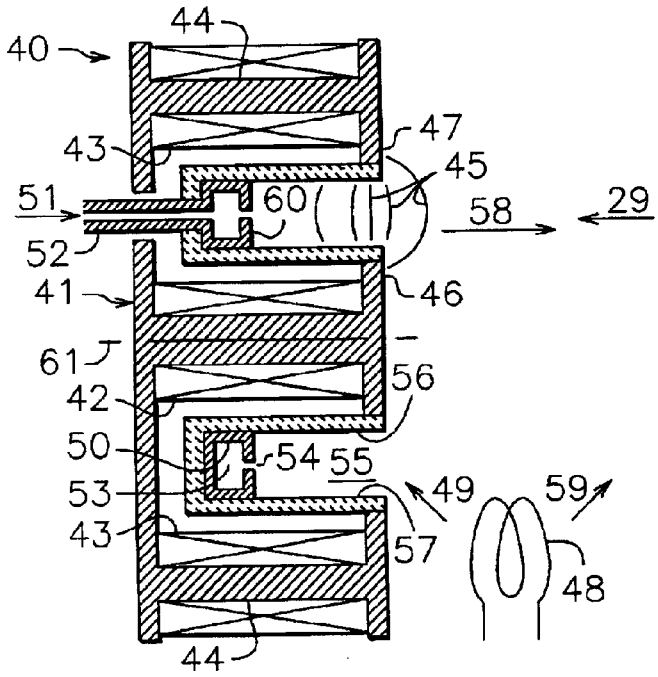
Fig. 2 (PRIOR ART)
FIG. 2 is a schematic cross-sectional view of a prior-art Hall-current ion source of the closed-drift type.

Referring now to FIG. 2, there is shown another approximately axisymmetric Hall-current ion source of the prior art, more particularly one of the closed-drift type. Ion source 40 includes a magnetically permeable path 41, which is magnetically energized by magnet coils 42 and 43. In the usual construction, magnetic paths 44 through outer magnet coils 43 are four equally-spaced discrete paths, rather than being strictly axially symmetric. (Electromagnets, magnet coils 42 and 43 are the magnetizing means in ion source 10, but permanent magnets could have been used instead.) Magnetic field 45 (shown only on one side of the axis of symmetry to reduce the clutter) is generated between magnetically permeable inner pole piece 46 and magnetically permeable outer pole piece 47. A discharge means is provided by electron-emitting cathode 48, which emits electrons 49 that flow toward anode 50. Ionizable gas 51 is introduced into ion source 40 through tube 52 which connects to anode 50. The anode is also a gas distribution manifold with an interior volume 53 to circumferentially distribute the gas to apertures 54, which in turn permit a flow of the gas to discharge region 55, which is enclosed at one end by anode 50 and laterally by inner and outer discharge chamber walls 56 and 57. Electrons 49 are constrained by magnetic field 45 located in discharge region 55 between cathode 48 and anode 50 and so oriented that the electrons cannot flow directly to anode 50, but remain in discharge region 55 until, through collision processes, they can diffuse across the magnetic field to the anode. Some of the collisions are with neutral atoms or molecules of ionizable gas and generate ions, which are accelerated in the axial direction to become ion beam 58. Additional electrons 59 from cathode 48 charge and current neutralize the ion beam.

With the exception of the tube 52, the outer magnet coils 43 and the permeable paths 44 therein, the configuration shown is essentially axially symmetric about axis 61. Ion beam 58 is generated in annular discharge region 55, but is axisymmetric about axis 61. The power supply requirements and electron-emitting cathode choices are similar to those described in connection with the end-Hall type of Hall-current ion source shown in FIG. 1.

The electrons that reach anode 50 in FIG. 2 are collected by surface 60, which faces discharge region 55. Surface 60 is also the "electron-collecting surface," which is defined as the anode surface readily available and utilized for electron collection. In contrast, to reach surfaces of anode 50 other than surface 60, electrons must cross additional magnetic field lines, diffuse farther from the discharge region, or both. Surface 60 is also exposed to externally generated contamination 29. Externally generated contamination 29 again follows straight-line trajectories from the points of origin. If a point on anode surface 60 can be reached directly by a straight line originating at another point external to ion source 40 (i.e., without being intercepted by another part of the ion source), that point on anode surface 60 can become coated with externally generated contamination.

The sources of contamination are generally similar to those described in connection with the end-Hall type of Hall-current source shown in FIG. 1. The particular closed-drift type of source shown in FIG. 2 has dielectric inner and outer discharge chamber walls 56 and 57, which are typically fabricated of refractory ceramic, which is also a dielectric. Walls 56 and 57 are subject to sputter erosion from collisions by energetic ions. The sputtered materials from the walls can therefore be deposited on anode surface 60 to form a poorly conducting or nonconducting coating thereon. The problems caused by such coatings on the anode are similar for the closed-drift and end Hall types of Hall-current ion sources.

Figure 2A:
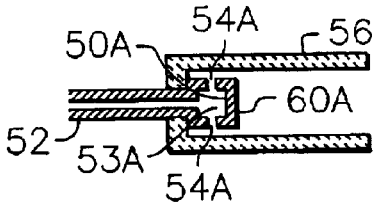
Fig. 2a (PRIOR ART)
FIG. 2*a* is an enlarged cross-sectional view of a portion of the Hall-current ion source shown in FIG. 2 using another anode configuration.
Figure 2B:
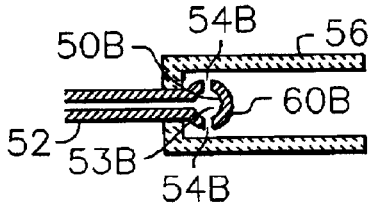
Fig. 2b (PRIOR ART)
FIG. 2*b* is an enlarged cross sectional view of a portion of the Hall-current ion source shown in FIG. 2 using yet another anode configuration.

Alternate anode configurations are shown in FIGS. 2*a* and 2*b*. Anodes 50A and 50B have different cross-sectional shapes than anode 50. Also, they have apertures 54A and 54B that are located behind anode surfaces 60A and 60B, which is desirable from the viewpoint of reducing the likelihood of arcs from the discharge region to the high-pressure interiors of the anode 53A and 53B. Surfaces 60A and 60B are the "electron-collecting surfaces," which are again defined as the anode surfaces readily available and utilized for electron collection. The problems of depositing and cleaning poorly conducting coatings on surfaces 60A and 60B are otherwise essentially the same as depositing such coatings on anode surface 60.

Disassembly and cleaning is, of course, a corrective action for a dielectric coating on the anode of a Hall-current ion source. With increasingly long production runs, however, cleaning is often an undesirable solution. The use of stainless steel for the anode (usually nonmagnetic to avoid distortion of the magnetic field) is a partial solution to reactive gases. But those skilled in plasma physics are aware that an ion or neutral striking the anode surface at an energy of several electron-volts is roughly equivalent to a chemical reaction temperature of tens of thousands of degrees Kelvin, and even stainless steel readily forms an oxide when struck by such an oxygen atom or ion.

One design approach to controlling the effects of dielectric coatings on the anode is described in the aforementioned U.S. Pat. No. 5,973,447—Mahoney, et al. The solution proposed therein is to introduce the working gas through an annular gap in a cooled anode. In this manner the electrical contact of the discharge to the anode can be sustained through the gap after exposed surfaces of the anode become coated with a nonconductive coating. Mahoney, et al., correctly define the need for an anode gap that is large compared to the Debye length, $\lambda_D$, defined as $$\lambda_D=(\in_o kT_e/n_e e^2)^{1/2}, \quad (1)$$

where $\in_o$ is the permittivity of free space, k is the Boltzmann constant, $T_e$ is the electron temperature, $n_e$ is the electron density, and e is the electronic charge. In a typical example, however, a minimum anode gap was calculated as 0.2 mm, which is not a difficult dimension to exceed. While Mahoney, et al, provide a partial solution to the anode coating problem, they neglect the effects of coatings on the exposed surfaces of the anode—i.e., not within the gap.

A Hall-current ion source of either the end-Hall or closed-drift types is sensitive to anode configuration. A poorly conductive or nonconductive coating on an anode is an anode configuration change that can adversely affect performance. The efficiency of operation can be reduced, reducing the ion beam energy and/or current at constant values of electrical operating parameters, or increasing the power required for generating the same ion-beam energy and/or current. The shape of the ion beam can also be altered, resulting in a reduction of either production rate or useful yield. If low-voltage operation is desired, it may be difficult or impossible to obtain such operation with a coating on the anode. In an extreme case, any operation of the ion source can be prevented by such a coating.

There is also the prior-art technology described in U.S. Pat. No. 5,218,271—Egorov, et al., in which curved gas passages and/or anode baffles to cover the ends of these gas passages are used. The stated objective of Egorov, et al., is avoid the contraction of the discharge in the vicinity of the anode wherein the discharge tends to penetrate the outlet passages of the anode and to the interior of the anode, thereby avoiding the increased discharge losses that accompany such contraction. Such contractions can also cause arcing damage to the anode.

In summary, the prior art focuses on gas passages within the anode. In the aforementioned U.S. Pat. No. 5,973,447—Mahoney, et al., the design improvement is a cooled anode together with a gap in the anode through which the ionizable gas is introduced. In the aforementioned U.S. Pat. No. 5,218,271—Egorov, et al., the ionizable gas leaves the interior of the anode through a plurality of gas passages. These gas passages are curved or they are straight and have baffles to cover the ends of the passages. In either case a direct line-of-sight is not possible from the exterior of the anode to the high-pressure interior through these passages.

DESCRIPTION OF THE PREFERRED EMBODIMENTS

Figure 3:
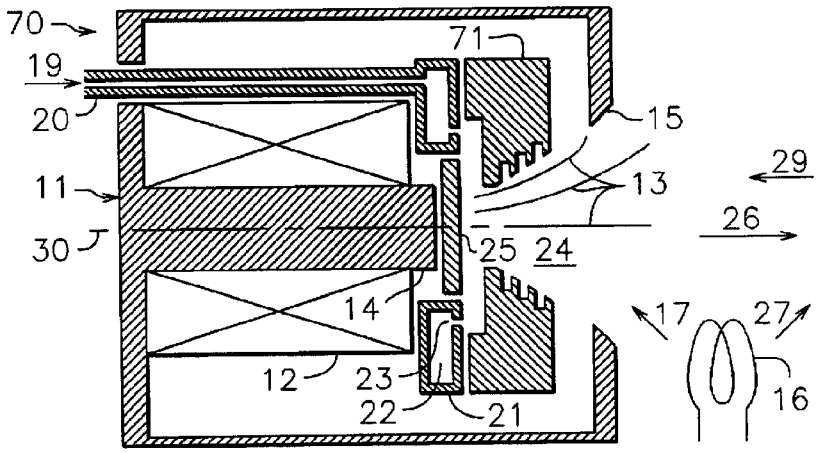
FIG. 3 is a schematic cross-sectional view of a Hall-current ion source of the end-Hall type constructed in accord with one embodiment of the present invention.

A preferred embodiment of the present invention is set forth in FIG. 3 in the form of an approximately axisymmetric Hall-current ion source of the end-Hall type. Ion source 70 in FIG. 3 is similar to ion source 10 in FIG. 1, except for the electron-collecting surface of anode 71 where electrons are collected. The "electron-collecting surface" is again defined as the anode surface readily available and utilized for electron collection. This area incorporates recesses in or protrusions from the electron-collection surface. The anode shape is shown more clearly in FIG. 3*a*, which is an enlarged view of the anode shown in FIG. 3. The recesses 72 are in the form of circumferential grooves in anode 71 that together increase the surface area available for electron collection. Compared to conical surface 28 of anode 18 in FIG. 1, there are only short conical segments 73 that correspond to conical surface 28.

The operation of ion source 70 in FIG. 3 is generally similar to that of ion source 10 in FIG. 1. A significant difference is found with the deposition of externally generated contamination 29 on the anode. This contamination is deposited on short conical segments 73 and some of adjacent surface 74. Most of the increased surface area in the electron-collecting surface of the anode is protected from contamination 29 by being in the shadowed surfaces within recesses 72 and remains clean. The shadowed surfaces are shown by areas 75 in FIG. 3*a*. These shadowed surfaces cannot be reached by straight lines originating at points external to ion source 70 (i.e., without being intercepted by another part of the ion source), hence cannot easily become coated with externally generated contamination 29.

The electron-collecting surface of anode 71 can be thought of as having depressions (the grooves) or, conversely, as having protrusions between the grooves. This ambiguity is shown more clearly in FIG. 3*b*, which shows the cross-section of an alternative anode 71A for ion source 70. If a circumferential grooved surface is assumed, then the surface contours of the anode may be thought of as recesses, if surfaces 76 are considered as indicating the original anode surface; or protrusions, if surfaces 77 are considered as indicating the original anode surface. On the other hand, if surfaces 76 are the tops of cylindrical extensions from the anode, then the surface contours become arguably only protrusions. But if surfaces 77 are the bottoms of cylindrical holes, then the surface contours become arguably only recesses. Further, the recesses and protrusions may be continuous (one long spiral shape) or discontinuous (many circular depressions or protrusions). To avoid the possibility of ambiguous or excessively narrow interpretation, a "contoured" surface will be defined as a surface that includes one or more recesses, one or more protrusions, or both. Consistent with this definition, a contoured surfaced is obtained by the process of "contouring" that surface.

In practice, there is some flexibility in what constitutes a shadowed area for the electron collecting surface of the anode. Externally generated contamination is often generated by ion beam 26 and the ion beam is generally confined to a direction approximately parallel to axis 30. In this case, substantial protection would be obtained for a portion of the electron-collecting surface if that surface were contoured so that a portion of its surface could not be reached by contamination originating external to the ion source and moving toward the source parallel to the beam axis. Described in geometric terms, a particular portion of the electron-collecting surface would be protected if this surface were contoured (i.e., it incorporates recesses and/or protrusions) so that such particular portion of this surface cannot be reached directly (not striking any other anode surface first) by any straight line originating external to ion source 70 and aligned parallel to axis 30.

If much of the contamination is generated from a specific piece of external hardware, it is possible to shadow anode surfaces from contamination arriving from that source. Described in geometric terms, a particular portion of the electron-collecting surface would be protected if this surface were contoured so that such particular portion of this surface cannot be reached directly by any straight line originating from a point external to the ion source that approximates the location of the contamination source.

Only in the case where extreme protection is required would it be necessary to shield an anode area from contamination that might arrive from any point external to the ion source.

Assuming that the recesses are at least several times wider than the Debye length, which was shown in the Description of Prior Art to be an easy requirement to meet, the plasma can penetrate into the recesses where substantial uncoated anode area is still available for the collection of electrons after the deposition of contamination on the ion source and exposed surface of the anode. Because this uncoated area is readily available for electron collection, near the coated area, the deposition of contamination has a reduced effect on operation.

Figure 3A:
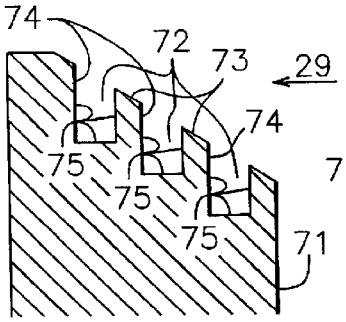
FIG. 3*a* is an enlarged cross-sectional view of a portion of the anode of the Hall-current ion source shown in FIG. 3.
Figure 3B:
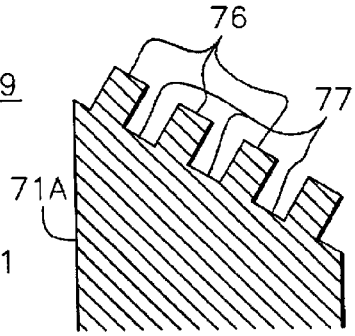
FIG. 3*b* is an enlarged cross-sectional view of a portion of another anode suitable for use in the Hall-current ion source shown in FIG. 3.

There are additional beneficial effects of the anode configuration shown in FIGS. 3 and 3*a*. Because of the depth of the recesses, short conical segments 73 are more thermally decoupled from the bulk of anode 71 than conical surface 28 is decoupled from the bulk of anode 18 in ion source 10 in FIG. 1. The temperature differences between short conical segments 73 and the bottoms of recesses 72 that results from this decoupling has important effects.

One effect has to do with electrical conductivity. Poorly conducting coatings of the type normally deposited on anodes tend to increase conductivity when heated. This is why operation is often not prevented by an anode coating until after the ion source has been shut down and cooled, after which the poorer conductivity to the cooled anode prevents a subsequent restart. With the higher temperatures of short conical segments 73, the conductivities of the coatings at those locations will be greater and the effect of the coating will thus be decreased during operation. At the same time, the uncoated area near the coated area will promote restarting after the ion source has been shut down and cooled.

The temperature differences between short conical segments 73 and the bottoms of recesses 72 will, particularly with on-off cycling of operation, result in increased thermomechanical delamination and spalling of the coating. For the grooved anode configuration tested in the Specific Examples section, the temperature gradient in the thin sections between the recesses in the stainless steel anode was calculated as being about 50° C./cm. The thermomechanical delamination would be particularly important when a nonconducting coating is deposited from the working gas, hence would be deposited on all the inside surfaces of the recesses instead of just on short conical segments 73 and exposed adjacent surface 74.

There is another beneficial effect of the anode configuration shown in FIGS. 3 and 3*a*. The plasma in Hall-current ion sources is generally in the strong-magnetic field regime. That is, the electron cyclotron frequency, $\omega_e$, and the total electron collision frequency, $\upsilon_e$, obey the relationship $$\omega_e/\upsilon_e >> 1. \quad (2)$$

Under these conditions, the plasma conductivity normal, $\sigma_\perp$, and parallel, $\sigma_\parallel$, to the magnetic field obey the relationship $$\sigma_\parallel >> \sigma_\perp. \quad (3)$$

From relationship (3) one might expect that the axial length of the conical anode surface in FIG. 1 is relatively unimportant. In other words, if the electrons can cross magnetic field lines to reach one that intercepts the anode, they can easily move parallel to the magnetic field to reach a narrow anode—one with a short axial length.

What is observed experimentally is that a reversed sheath forms at a narrow anode, with the anode potential more positive than the plasma adjacent to the sheath. The ability of the plasma to conduct a discharge current to the anode is limited by the electron density. The normal negative sheath disappears when the local current density to the sheath requires that all the arriving electrons be collected by the anode. Any attempt to further increase the discharge current density beyond this point results in a reversed sheath, in which the anode is more positive than the plasma adjacent to the sheath. The decrease in electron-collecting surface due to the use of a narrow anode causes both the increase in discharge current density and, if the anode is sufficiently narrow, a reversed sheath.

Such a reversed sheath results in excessive discharge power loss with much of this loss appearing as anode heating. As an example of this effect, the Mark II end-Hall ion source originally manufactured by Commonwealth Scientific Corporation and now manufactured by Veeco Instruments Inc., has an anode shape that closely resembles the one shown in FIG. 1 with an axial length of 22 mm. If that axial length were reduced to 3–5 mm, the performance of the Mark II source would be drastically reduced and the present maximum-power, high-voltage discharge current of 5 A would probably result in the narrow anode being melted. The requirement for an adequate plasma-anode contact area to avoid a reversed plasma sheath is the reason that conical surface 28 in FIG. 1 approximately follows the shape of the adjacent magnetic field line.

The plurality of recesses in contoured anode 71 of ion source 70 in FIG. 3 provides a plurality of uncoated anode areas 75 with a total surface area that approximates the conical surface of anode 18 of ion source 10 in FIG. 1. An excess of plasma-anode contact area is provided in most Hall-current ion-source designs, so that the exact contact area of the uncoated anode is not crucial. If the ion-source performance is to be nearly unchanged by an electrically poorly conducting or nonconducting coating on the anode, however, it is important that the plasma-anode contact area be more than the single narrow strip maintained by Mahoney, et al., in the aforementioned U.S. Pat. No. 5,973,447. The change in operating characteristics can be reduced to a moderate level if the total anode area that is shadowed against the deposition of contamination is approximately one-third (e.g., about 30 percent) or more of the total area that can be utilized for electron collection before the deposition of contamination.

Figure 4A:
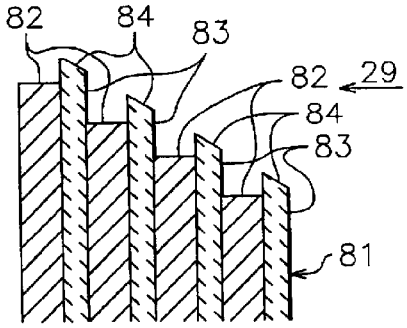
FIG. 4*a* is an enlarged cross-sectional view of a portion of the anode of the Hall-current ion source shown in FIG. 4.
Figure 4:
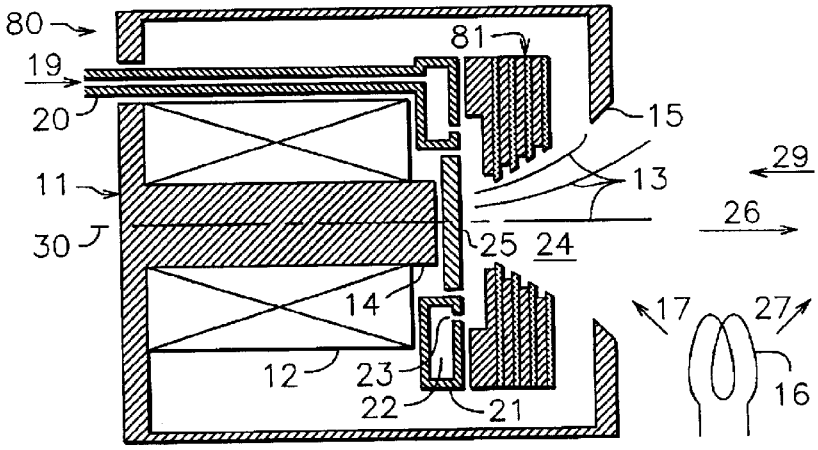
FIG. 4 is a schematic cross-sectional view of a Hall-current ion source of the end-Hall type constructed in accord with another embodiment of the present invention.

Another preferred embodiment of the present invention is set forth in FIG. 4 in the form of another approximately axisymmetric Hall-current ion source of the end-Hall type. Ion source 80 in FIG. 4 has anode 81 that has an overall shape roughly similar to anode 71 in FIG. 3. Anode 81, though, differs in having a laminar construction that permits it to be taken apart for maintenance. Anode 81 is shown more clearly in FIG. 4*a*, which is an enlarged view of the anode shown in FIG. 4. Conducting layers 82 collectively constitute the anode. They are electrically connected in parallel to the positive terminal of a discharge power supply (not shown), while electron-emitting cathode 16 is again connected to the negative terminal.

Nonconducting layers 83 protect conducting layers 82 due to ends 84 of nonconducting layers 83 extending beyond conducting layers 82 sufficiently far to shadow the conducting layers from contamination 29. As discussed in connection with FIG. 3, a moderate degree of protection would be obtained in many applications by protection against contamination that is moving toward the ion source in a direction parallel to the source axis. In FIG. 4*a*, this degree of protection would be provided by ends 84 of nonconducting layers 83 extending slightly beyond conducting layers 82. To provide for variation in parts and variation in the trajectories of contamination, a slightly larger extension would usually be used—typically one-quarter or one-third the thickness of the conducting layer being protected. The anode environment is hot and the nonconducting function of layers 83 is best provided by a ceramic material.

The same anode configuration could be used with layers 83 fabricated of a conducting material, but an advantage would be lost for ion source 80. With conducting layers 83, much of the initial electron collection by anode 81 would be by projecting ends 84 of layers 83. Then, as these projecting ends became coated with contamination 29, the electron collection would shift to protected layers 82. This shift in electron collection would result in a change in ion-source performance. By using nonconducting layers 83, the change in performance due to the deposition of contamination is minimized.

Figure 5:
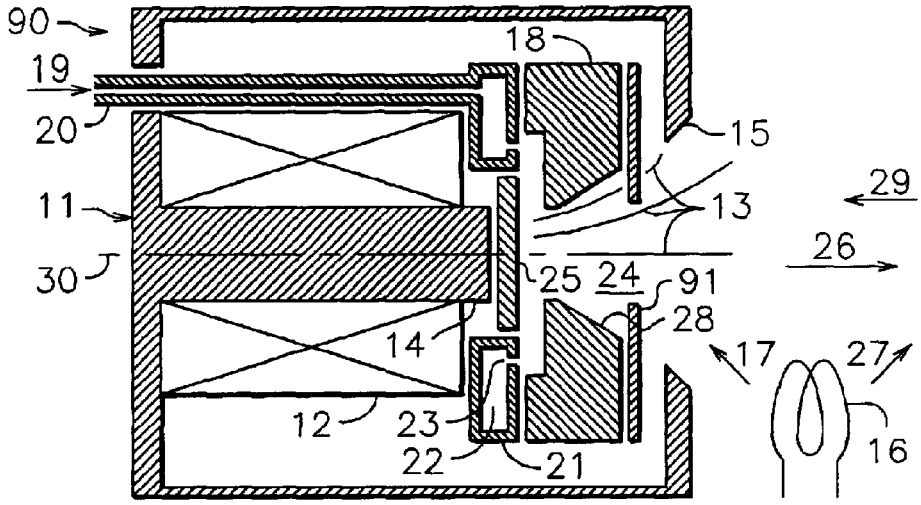
FIG. 5 is a schematic cross-sectional view of a Hall-current ion source of the end-Hall type constructed in accord with yet another embodiment of the present invention.

Yet another preferred embodiment of the present invention is set forth in FIG. 5 in the form of yet another approximately axisymmetric Hall-current ion source of the end-Hall type. Ion source 90 in FIG. 5 is similar to ion source 10 in FIG. 1, except for the addition of electrically isolated baffle 91. Baffle 91 protects much of conical surface 28 from contamination 29—typically one-third (e.g., about 30 percent) or more of conical surface 28 is protected from contamination 29 that is moving parallel to axis 30 of ion source 90. This baffle could be fabricated of either a conductor or a nonconductor, but is indicated in FIG. 5 as being metallic because metallic electrodes are usually more economical to fabricate. Being metallic, it could either be controlled to have a particular electrical potential, or allowed to "float." To minimize the change in ion source operation when coated with a poor conductor or a nonconductor, a floating potential is preferred for baffle 91.

Figure 5A:
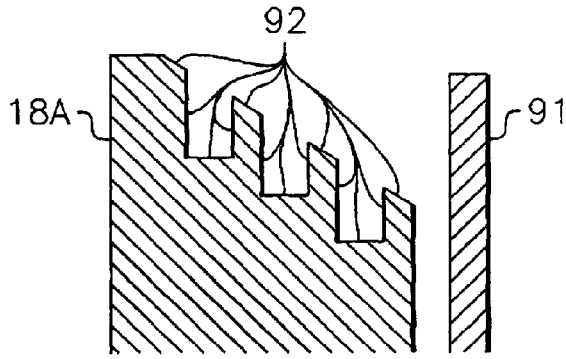
FIG. 5*a* is an enlarged cross-sectional view of a portion of the Hall-current ion source shown in FIG. 5 using another anode configuration.

A modification of the embodiment of the present invention shown in FIG. 5 is shown in FIG. 5*a*. Anode 18 is replaced by contoured anode 18A, which incorporates the circumferential grooves of anode 71 in FIG. 3 and has contoured electron-collecting surface 92. The embodiment of FIG. 5*a* thus includes both a contoured anode and a baffle.

Figure 6:
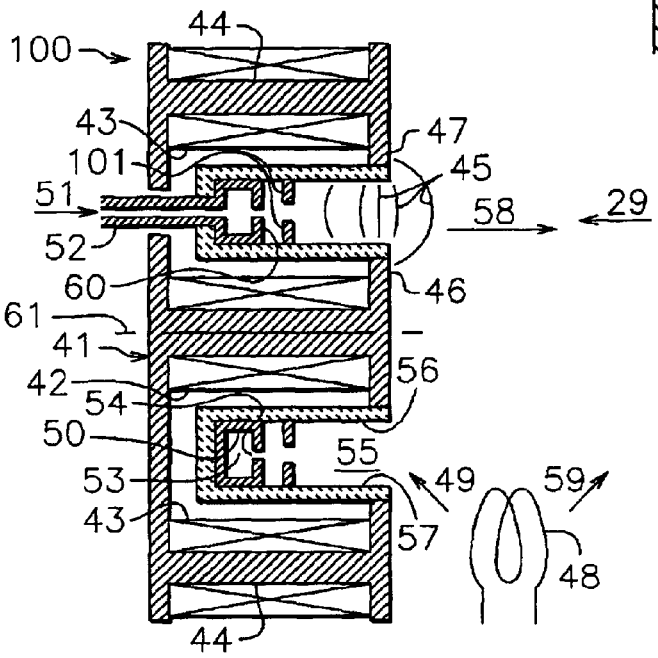
FIG. 6 is a schematic cross-sectional view of a Hall-current ion source of the closed drift type constructed in accord with an embodiment of the present invention.

Still another preferred embodiment of the present invention is set forth in FIG. 6 in the form of still another approximately axisymmetric Hall-current ion source, this time of the closed-drift type. Ion source 100 in FIG. 6 is similar to ion source 40 in FIG. 2, except for the addition of baffles 101. The function of baffle 101 in ion source 100 is similar to that of baffle 91 in ion source 90, i.e., to protect the anode from contamination 29. Typically approximately one-third (e.g., about 30 percent) or more of anode surface 60 is protected from contamination 29 that is moving parallel to axis 61 of ion source 100. Although different materials and different electrical potentials could be used for baffles 101, a metallic material at a floating potential is again preferred for the same reasons given in the discussion of ion source 90.

SPECIFIC EXAMPLES

The Mark II end-Hall ion source, originally manufactured by Commonwealth Scientific Corporation and now manufactured by Veeco Instruments Inc., is a prior-art Hall-current ion source with an anode that closely resembles the one shown in FIG. 1. The conical surface of the Mark II anode (corresponding to conical surface 28 in FIG. 1) has an inside diameter of 20 mm and an outside diameter of 36 mm. The Mark II ion source was operated with an argon flow of 100 sccm (standard cubic centimeters per minute). The cathode was the HCES 5000, also first manufactured by Commonwealth Scientific Corporation and later manufactured by Veeco Instruments Inc., was operated with an argon flow of 20 sccm. The sputter target was tantalum and was biased to −500 V relative to the vacuum-chamber ground by a pulsed power supply. An oxygen flow of 50 sccm was directed at the deposition substrate. The experimental configuration of source, target, and deposition substrate was the same as that described by Zhurin, et al., in *J. of Vacuum Science and Technology*, Vol. A18, beginning on page 37. The anode current was 7.5 A while the cathode emission was 10 A.

Figure 7:
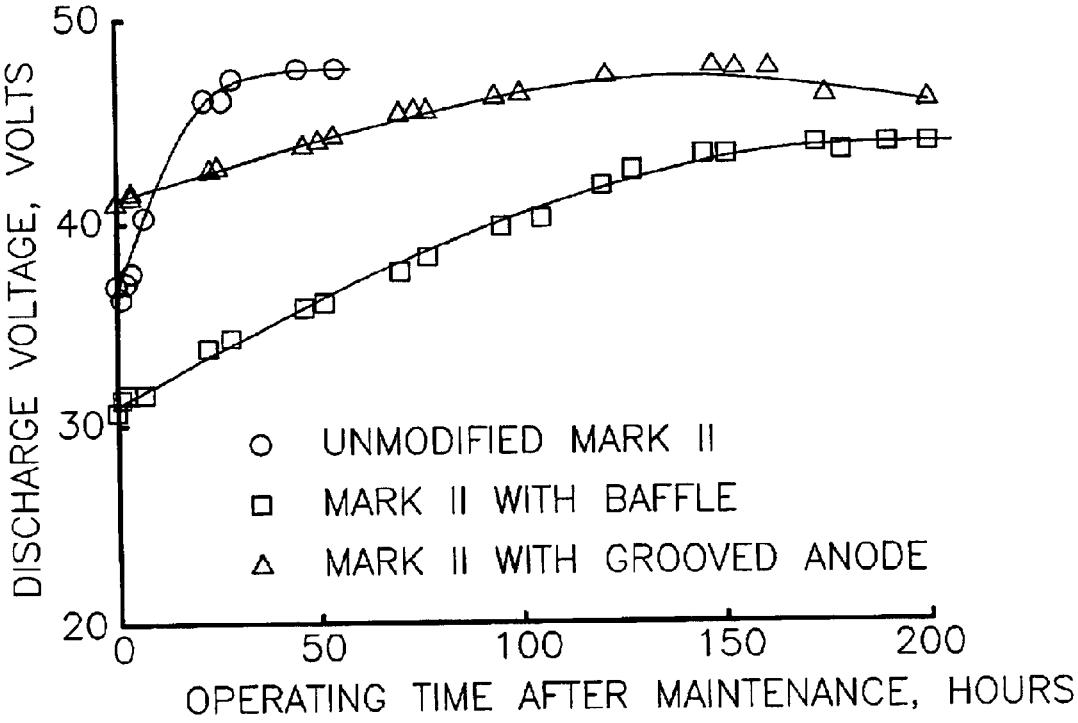
FIG. 7 depicts the variation of discharge voltage with operating time after maintenance for both unmodified and modified configurations of the Mark II end-Hall ion source.

There was deposition of tantalum oxide on the Mark II ion source as well as the deposition substrate. This deposition interfered with the collection of electrons by the anode and caused the anode voltage to rise with increased operating time after maintenance, i.e., after cleaning. This rise is shown by the "Unmodified Mark II" data in FIG. 7. A low discharge voltage corresponds to a low ion energy and is desired in biased target deposition as described by Zhurin, et al., in the aforesaid paper in *J. of Vacuum Science and Technology*. The rise in anode voltage shown in FIG. 7 is therefore a measure of the degradation of ion source performance due to the deposition of a coating on the Mark II anode.

The Mark II ion source was also modified with the addition of a baffle, similar to baffle 91 shown in FIG. 5. The baffle was approximately 0.5 mm thick, spaced 5 mm from the anode, and had an inside diameter of 23 mm. The conical surface of the anode with an inside diameter of 20 mm was thus incompletely "shadowed" or protected by the baffle. The rise in discharge voltage with operating time after maintenance for this modified Mark II is shown by the "Mark II with Baffle" data in FIG. 7. It is apparent that the discharge voltage rises much more slowly for the modified Mark II. For example, the operating time for the discharge voltage to increase by 10 volts after performing maintenance is about 25 hours for the unmodified Mark II. For the Mark II with a baffle the same increase takes about 110 hours, or more than four times as long.

It should also be mentioned that there was a performance decrease due to the installation of the baffle. The ion current collected by the biased target was about 200 mA for the unmodified Mark II. The ion current collected after the installation of the baffle was about 120 mA. If the processing capabilities of the ion sources were measured in ampere-hours of operation instead of hours, though, the advantage of the modified Mark II would still be a factor of 2.6 ((0.12×110)/(0.2×25)) over the unmodified Mark II. By any reasonable measure, there was a substantial advantage in low-voltage operation for the Mark II with a baffle.

The anode of a Mark II ion source was also contoured by incorporating circumferential grooves in the electron-collecting surface of the anode, similar to those shown in FIG. 3. Seven grooves were included, each with a depth of about 2.5 mm, a width of 1.5 mm, and an axial distance of one mm between grooves. The rise in discharge voltage with operating time after maintenance for this modified Mark II is shown by the "Mark II with Grooved Anode" data in FIG. 7. It is apparent that the discharge voltage rises much more slowly than for the modified Mark II. In fact, there was a decrease in voltage after 150 hours of operation. Examination of the anode after the completion of the 200-hour test showed some delamination or spalling of the deposited film from the short conical segments between the grooves and some of the adjacent exposed area. It appears likely this spalling would continue and that the discharge voltage would have remained within the range shown for 150–200 hours for some indefinite additional time had the test continues.

Because the voltage rise with the grooved anode was less than 10 volts during the entire 200 hour test duration, a comparison with the unmodified Mark II was made at a smaller rise in discharge voltage. The time for the discharge voltage of the unmodified Mark II to increase by five volts after performing maintenance is about 10 hours. For the Mark II with a grooved anode the same increase takes about 90 hours, or nine times as long. Unlike the Mark II with a baffle, the ion current collected with the target actually increased over that of the unmodified Mark II. Again compared to the unmodified Mark II, the use of the grooved anode gave more than a factor of ten greater processing capability.

Alternate Embodiments

Configurations that are essentially axisymmetric have been assumed herein. Examination of the references cited will show that Hall-current ion sources have been made in which the cross sections of the discharge regions have elongated or "race-track" shapes.

In a similar manner, the ion beam has been assumed to be generated in a generally axial direction. It is also possible to utilize the present invention to construct Hall-current ion sources where the ion beam is directed in a radial or conical direction.

Figure 8:
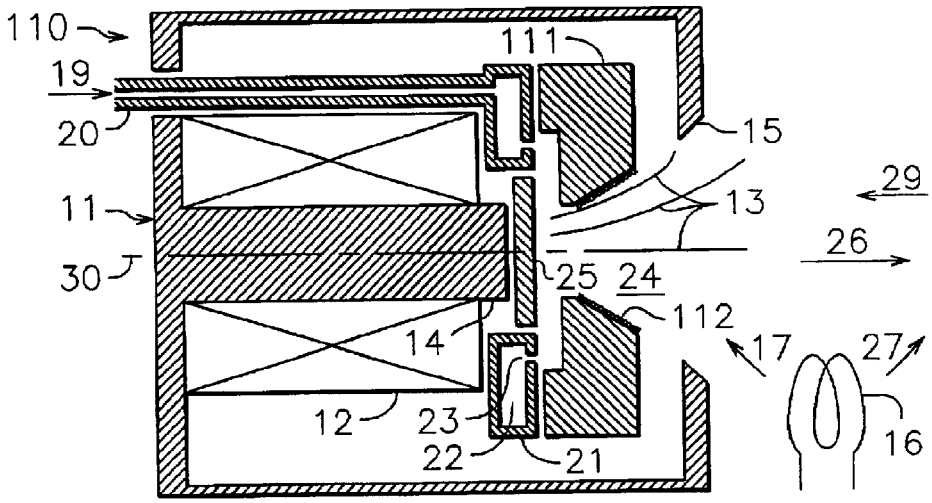
FIG. 8 is a schematic cross-sectional view of a Hall-current ion source of the end-Hall type constructed in accord with an alternate embodiment of the present invention.
Figure 8A:
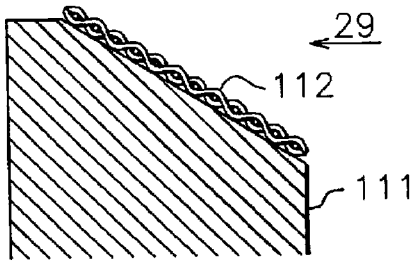
FIG. 8*a* is an enlarged cross-sectional view of a portion of the anode of the Hall-current ion source shown in FIG. 8.

The anode configurations in this invention have included electron-collecting areas that are protected against the deposition of externally generated contamination by the contoured shape of the anode. Such protected areas could also be provided by incorporating a stainless-steel mesh into the collection surface, rather than machining grooves in the anode. This configuration is shown for approximately axisymmetric Hall-current ion source of the end-Hall type 110 in FIG. 8, in which anode 111 has a metallic screen attached to the conical surface of the anode. An enlarged view of a portion of anode 111 and the attached screen is shown in FIG. 8*a*. The irregular contoured surface of the screen-coated anode provides an increased electron-collecting area, with approximately half of the area of the screen shadowed from deposition 29.

Figure 9A:
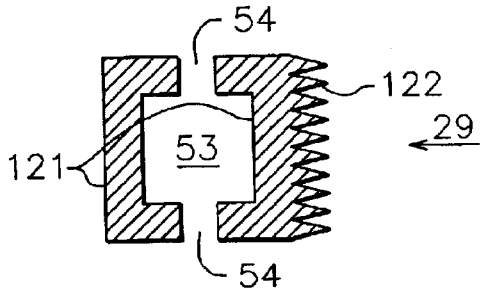
FIG. 9*a* is an enlarged cross-sectional view of a portion of the anode of the Hall-current ion source shown in FIG. 9.
Figure 9:
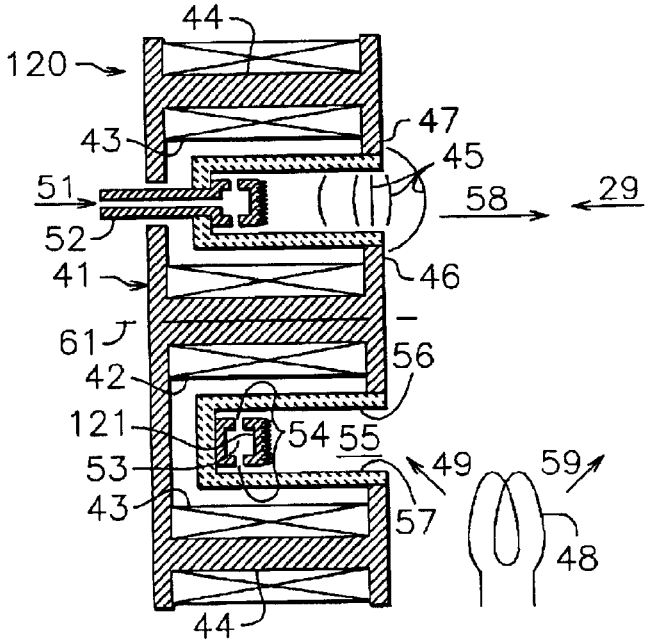
FIG. 9 is a schematic cross-sectional view of a Hall-current ion source of the closed-drift type constructed in accord with an alternate embodiment of the present invention.

However, it is not necessary to have some portions of the anode surface that are protected more than other portions. The cross section of the electron-collecting surface of the anode could be contoured in a saw-toothed shape in which all portions of the anode have the same viewing angle for externally generated contamination. Such a configuration is shown for approximately axisymmetric Hall-current ion source of the closed-drift type 120 in FIG. 9. An enlarged view of anode 121 in which electron collecting area 122 is contoured in this manner is shown in FIG. 9*a*. Note that all surfaces are equally exposed to contamination that approaches the electron-collecting area on paths parallel to axis 61. For the same volume of deposited contamination, the increase in anode area would then result in a corresponding decrease in coating thickness, hence a decrease in the electrical potential difference between the anode and the exposed surface and a resultant increase in permissible operating time. In FIG. 9*a* electron-collecting surface 122 is increased by a factor of several over equivalent surface 60 in ion source 40 shown in FIG. 2. In addition, the tops and bottoms of the saw-toothed contours would have the desirable temperature differences described in connection with ion source 70 in FIG. 3. It should be evident from the preceding discussion and FIGS. 9 and 9*a* that shadowed or otherwise protected areas on the electron-collecting surface of the anode are not necessary to obtain the benefits of this invention if the contoured anode provides a substantial increase, approximately one-half or more (e.g., an increase of approximately 50 percent or more) in the area of the electron-collecting surface, when compared to the area of the electron-collecting surface before contouring such surface—comparing for example, the area of surface 122 in FIG. 9*a* with surface 60A in FIG. 2*a*.

While particular embodiments of the present invention have been shown and described, and various alternatives have been suggested, it will be obvious to those of ordinary skill in the art that changes and modifications may be made without departing from the invention in its broadest aspects, Therefore, the aim in the appended claims is to cover all such changes and modifications as fall within the true spirit and scope of that which is patentable.

We claim:

1. A Hall-current ion source apparatus comprising:

a discharge region;

means for supplying a flow of ionizable gas to said region;

an electron-emitting cathode at or near one end of said region;

an anode within said region whereon said anode has an electron-collecting surface;

a magnetic-field within said region and located between said surface and said cathode;

discharge means to generate ions from said gas and accelerate said ions out of said region;

characterized by said electron-collecting surface being contoured with a plurality of recesses or protrusions so as to increase the area of said surface by approximately one-half as compared to the area of said surface without said recesses or protrusions.

2. A Hall-current ion source in accordance with claim 1, wherein said electron-collecting surface is contoured with a plurality of conical recesses.

3. A Hall-current ion source in accordance with claim 1, wherein said electron-collecting surface is contoured with a plurality of protrusions.

4. A Hall-current ion source in accordance with claim 1, wherein said electron-collecting surface comprises a plurality of saw tooth contours.

5. A Hall-current ion source in accordance with claim 1, wherein said electron-collecting surface comprises a mesh screen.

6. A Hall-current ion source in accordance with claim 1, wherein said electron-collecting surface is contoured with a continuous spiral recess.

7. A Hall-current ion source apparatus comprising:

a discharge region;

one or more apertures within said region;

means for supplying a flow of ionizable gas to said region through said one or more apertures;

an electron-emitting cathode at or near one end of said region;

an anode within said region whereon said anode has an electron-collecting surface;

a magnetic-field within said region and located between said anode and said cathode;

discharge means to generate ions from said gas and accelerate said ions out of said region;

characterized by said electron-collecting surface being contoured with a plurality of recesses or protrusions, wherein approximately one-third or more of the area of said electron-collecting surface cannot be reached by straight lines originating from a given point exterior of said ion source.

8. A Hall-current ion source apparatus comprising:

a discharge region;

one or more apertures proximate to said region;

means for supplying a flow of ionizable gas to said region through said one or more apertures;

an electron-emitting cathode at or near one end of said region;

an anode within said region whereon said anode has an electron-collecting surface with said surface located between said apertures and said one end;

a magnetic-field within said region and located between said anode and said cathode;

discharge means to generate ions from said gas and accelerate said ions out of said region;

characterized by said electron-collecting surface being contoured with a plurality of recesses or protrusions, wherein approximately one-third or more of the area of said electron-collecting surface cannot be reached by straight lines originating from a given point exterior of said ion source.

9. A method for making a Hall-current ion source including:

providing a discharge region;

providing a means for supplying a flow of ionizable gas to said region;

providing an electron-emitting cathode at or near one end of said region;

providing an anode within said region with said anode having an electron-collecting surface thereon;

providing a magnetic-field within said region and located between said anode and said cathode;

providing a discharge means to generate ions from said gas and accelerate said ions out of said region; and providing contours in said electron-collecting surface wherein said contours comprise a plurality of recesses or protrusions which increase the area of said surface by approximately one-half or more as compared to the area of said surface without said recesses or protrusions.

10. A method for making a Hall-current ion source including:

providing a discharge region;

providing a means for supplying a flow of ionizable gas to said region;

providing an electron-emitting cathode at or near one end of said region;

providing an anode within said region with said anode having an electron-collecting surface thereon;

providing a magnetic-field within said region and located between said anode and said cathode;

providing a discharge means to generate ions from said gas and accelerate said ions out of said region; and contouring said electron-collecting surface by creating a plurality of recesses in or protrusions on said surface so that approximately one-third or more of the area of said electron-collecting surface cannot be reached by straight lines originating from a given point exterior of said ion source.

11. A method for making a Hall-current ion source including:

providing a discharge region;

providing one or more apertures proximate to said discharge region;

providing a means for supplying a flow of ionizable gas to said region through said one or more apertures;

providing an electron-emitting cathode at or near one end of said region;

providing an anode within said region with said anode having an electron-collecting surface thereon;

locating said surface between said apertures and said one end;

providing a magnetic-field within said region and located between said anode and said cathode;

providing a discharge means to generate ions from said gas and accelerate said ions out of said region; and contouring said electron-collecting surface by creating a plurality of recesses or protrusions on said surface so that approximately one-third or more of the area of said electron-collecting surface cannot be reached by straight lines originating from a point exterior of said ion source.

12. A Hall-current ion source apparatus comprising:

a discharge region;

means for supplying a flow of ionizable gas to said region;

an electron-emitting cathode at or near one end of said region;

an anode having an electron-collecting surface facing said region;

a magnetic-field within said region and located between said surface and said cathode;

discharge means to generate ions from said gas and accelerate said ions out of said region;

characterized by said electron-collecting surface having a plurality of recesses so as to increase the area of said surface by approximately one-half or more as compared to the area of said surface without said recesses.

13. A method for making a Hall-current ion source comprising the steps of:

providing a discharge region;

providing a means for supplying a flow of ionizable gas to said region;

providing an electron-emitting cathode at or near one end of said region;

providing an anode having an electron-collecting surface facing said discharge region;

providing a magnetic-field within said region and located between said anode and said cathode;

providing a discharge means to generate ions from said gas and accelerate said ions out of said region; and contouring said electron-collecting surface with a plurality of recesses so as to increase the area of said surface by approximately one-half or more as compared to the area of said surface without said recesses.

14. A Hall-current ion source comprising:

a discharge region;

one or more apertures within said region;

means for supplying a flow of ionizable gas to said region through said one or more apertures;

an electron-emitting cathode at or near one end of said region;

an anode within said region whereon said anode has an electron-collecting surface; wherein said anode comprises a plurality of conducting layers separated by a respective plurality of non-conducting layers; wherein said non-conducting layers extend beyond said conducting layers;

a magnetic-field within said region and located between said anode and said cathode; and discharge means to generate ions from said gas and accelerate said ions out of said region.

* * * * *